United States Patent [19]

Griffin

[11] Patent Number: 4,475,661

[45] Date of Patent: Oct. 9, 1984

[54] TAMPER-INDICATING CONTAINER ASSEMBLY

[76] Inventor: Robert B. Griffin, 252 Tunxis Rd., West Hartford, Conn. 06107

[21] Appl. No.: 446,684

[22] Filed: Dec. 3, 1982

[51] Int. Cl.[3] ..... A61J 1/001

[52] U.S. Cl. ..... 215/366; 215/230; 220/214; 206/807; 206/459

[58] Field of Search ..... 215/365, 366, 230, 203, 215/280; 220/214; 206/807, 459

[56] References Cited

U.S. PATENT DOCUMENTS

| | | | |
|---|---|---|---|
| 2,201,205 | 5/1940 | Samburg | 215/230 |
| 2,387,955 | 10/1945 | Tilson | 215/230 |
| 2,939,597 | 6/1960 | Greene | 215/230 |
| 3,930,588 | 1/1976 | Coursaut | 215/230 |

FOREIGN PATENT DOCUMENTS

| | | | |
|---|---|---|---|
| 1217849 | 12/1960 | France | 215/230 |

*Primary Examiner*—Joseph Man-Fu Moy

*Attorney, Agent, or Firm*—Prutzman, Kalb, Chilton & Alix

[57] ABSTRACT

A tamper-indicating container assembly comprising: a receptacle portion for holding material to be dispensed, said receptacle portion having an opening for removal of the material held therein, a removable cap for closing off said receptacle opening to maintain the material therein, said cap having a transparent window, an indicator assembly forming a defaceable visual pattern and being connected to said cap so that the visual pattern is viewable through the window when said cap is mounted on the receptacle portion, and means for binding the visual pattern to the receptacle so that movement of said cap relative to the receptacle defaces the visual pattern so as to be substantially irreparable with the defaced visual pattern being viewable through the window.

17 Claims, 5 Drawing Figures

TAMPER-INDICATING CONTAINER ASSEMBLY

BACKGROUND OF THE INVENTION

This invention relates to container assemblies and more particularly to a tamper-indicating container assembly.

A vast amount of medicines, food, and other consumables are sold and distributed to the public in packaging and containers that are susceptible to heretofore undetectable tampering and adulteration of the products. Recent nation-wide events involving the altering and poisoning of food and medicine products has confirmed the necessity for a reliable tamper-indicating container assembly.

Consequently, it is desirable that a tamper-indicating container assembly provide an immediate and positive visual indication of tampering of any form and degree, and that the means for indicating such tampering be easily understandable by the consuming public. Furthermore, it must be insusceptible to unauthorized duplication to prevent repackaging.

It is also desirable that such a container assembly be adaptable for use with a wide variety of packaged consumables and compatible to presently used packaging machines.

Accordingly, it is an object of the present invention to provide a new and improved tamper-indicating container assembly that provides a readily visible indicator of tampering which is easily understood and perceived as such by the consuming public.

It is also an object of the present invention to provide such a tamper-indicating container assembly that cannot be readily avoided, foiled, or duplicated.

A further object is to provide such a tamper-indicating container assembly which is adaptable to a wide variety of packaged products and which conforms to present packaging techniques and packaging machinery.

Yet another object is to provide such a tamper-indicating container assembly that is economical to manufacture, durable in use, and aesthetically pleasing in appearance.

Other objects will in part be obvious and pointed out more in detail hereinafter.

SUMMARY OF THE INVENTION

It has been found that the foregoing and related objects and advantages can be readily obtained in a tamper-indicating container assembly which includes a receptacle for holding the product to be dispensed and a removable cap for enclosing the receptacle's opening. An indicator element is connected to the cap so as to present an outwardly visible predetermined defaceable visual pattern. The defaceable visual pattern of the indicator element is interconnected to the receptacle and cap so that movement of the cap relative to the receptacle defaces the visual pattern so as to be substantially irreparable.

In one preferred embodiment, the indicator element is a lenticular sheet assembly comprised of upper and lower lenticular sheets mounted within a bore in the cap so as to present an aesthetically pleasing visual pattern facing outwardly from the cap. The reflective coating of the lower sheet is adhered to the receptacle or a removable seal enclosing the receptacle opening so that, upon the initial movement of the cap relative to the receptacle, a portion of the reflective coating is separated from the lower sheet to thereby deface the visual pattern of the lenticular assembly to visually indicate the cap has been moved.

DESCRIPTION OF THE PREFERRED EMBODIMENTS

Figure 1:
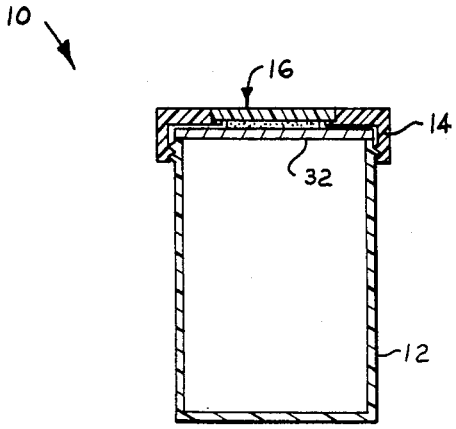
FIG. 1 is a sectional view of the tamper-indicating container assembly of this invention.

Referring to the drawings in detail wherein like numerals are used to designate the same or like parts throughout, the tamper-indicating container assembly of this invention is generally designated by the numeral 10 and is shown in FIG. 1.

For purposes of illustration, container assembly 10 is shown in the form of a conventional pill bottle or receptacle 12 having a removeable twist type lid or cap 14. However, as will be apparent to one of ordinary skill in the art, the present invention can be utilized with other types of lids or caps and also with a wide variety of containers, packaging systems, and dispensing units and even product identification systems.

Referring to FIG. 1, container assembly 10 is generally comprised of receptacle 12, cap 14, and indicator subassembly 16. Indicator subassembly 16 forms an outwardly visible predetermined defaceable visual pattern. As will be explained in detail, the defaceable visual pattern is operationally interconnected to the receptacle 12 and cap 14 so that movement of the cap relative to the receptacle (subsequent to the manufacturer's final packaging operation) causes a defacement of the visual pattern with the defacement being substantially irreparable.

Figure 2:
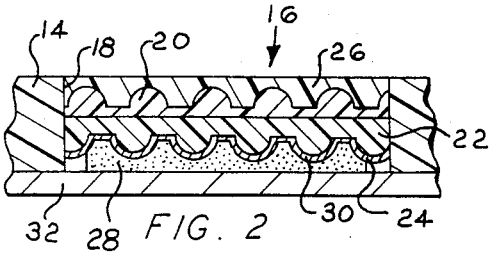
FIG. 2 is an enlarged sectional view of a portion of the tamper-indicating subassembly and cap of FIG. 1.

Turning to FIG. 2 in detail, indicator subassembly 16 is a lenticular sheet system mounted within bore 18 of cap 14 and having an upper lenticular sheet 20 and a lower lenticular sheet 22. Lower lenticular sheet 22 is coated on its lower or inner surface such as by a conventional vaccum process by a reflective coating 24 such as aluminum. A lenticular sheet system such as shown in FIG. 2 produces striking optical effects such as brilliant three-dimensional or spacial patterns having an asymmetrical or non-linear moire-like appearance or a symmetrical or linear appearance. Such systems generally include a pair of thin lenticular sheets having embossed patterns of generally hemispherical lenses or lens-like formations. The lenses may be arranged in rows or columns having the same lens pitch and with alternating rows or columns offset by one-half the lens pitch. In order to produce dramatic visual effects, the lenses of the two superimposed lenticular sheets may have different diameters, may be laterally or angularly offset or may have varying diameters. Many different and varied types of lens embossments and patterns may be effectively employed to produce a large variety of different types of striking spatial patterns.

Such lenticular systems produce highly distinctive visual patterns that are particularly suited for the tamper-indicating container assembly of the present invention because of the difficulty of duplicating or counterfeiting such patterns and because of the restrictive availability of such materials. A new and improved lenticular system particularly suited for the present invention is disclosed in the copending patent application of Robert B. Griffin for Method and Apparatus for Producing Visual Patterns with Lenticular Sheets, U.S. Pat. Ser. No. 230,862, filed Feb. 2, 1981 which is incorporated herein by reference.

Returning to FIG. 2, a transparent coating or layer 26 is disposed above the upper lenticular sheet 20 to seal indicator subassembly 16 within cap 14 and allow the visual pattern of the lenticular sheets to be readily visible from the top of the container assembly 10. An adhesive material 28 binds a portion 30 of the reflective coating 24 on the lower lenticular sheet 22 to a manufacturer's seal 32. The manufacturer's seal 32 is a common seal placed over the opening of the receptacle 12 to maintain purity and prevent contamination and is secured by a suitable adhesive to the upper edge or rim of the receptacle 12. Such seals are, however, easily duplicated and do not provide an effective deterrent to tampering and altering of the contents of the container. The seal is commonly made of aluminum foil but can be made of puncture resistant material to prevent penetration by a hypodermic needle.

The adhesive material 28 is applied just before installing the cap 14 and so that the adhesive layer 28 operates to bind the portion 30 of coating 24 to the seal 32 and consequently to receptacle 12 so that upon the initial movement of cap 14 to gain access to the receptacle 12, the adhesive will pull off or separate the portion 30 of coating 24 from the lower lenticular sheet 22. The adhesive 28 must have sufficient strength and adherence to remove the coating 24 when the cap is moved and preferably also provides for weakening the adhesive of the coating 24 to the sheet 22. For some types of containers, access to the receptacle is attained by removing the cover while in other types of containers access is attained by rotative manipulation of a top to align apertures, e.g., a ground pepper can. The present embodiment will result in removal of the reflective coating upon a rotative movement or a removal movement. However, the invention is not restricted to either or both of these types of movement.

The removal of a portion of the reflective coating 24 markedly defaces the visual pattern presented by the lenticular system thereby vividly indicating that the cap has been moved or tampered with. For all practical purposes, the removed reflective coating cannot be reapplied to the lower lenticular sheet 20 to hide the fact that the cap has been moved. Furthermore, replacement of the entire lenticular system is prevented by the difficulty of matching the highly distinctive visual patterns produced by such systems. Also, the lenticular sheets may be custom designed to make duplication extremely difficult. Thus, a readily visible indicator of tampering is obtained with minimal handling of the container.

Alternatively, the outer circumferential portion of coating 24 may be bound by an adhesive material directly to the rim of receptacle 12 rather than to the manufacturer's seal 32. In this configuration, the relative movement of cap 14 to receptacle 12 would again cause adhesive material 28 to separate a portion of the reflective coating from the lower lenticular sheet 22 to thereby deface the visual pattern. In this embodiment (not shown), the lenticular sheets would necessarily extend to a position adjacent the rim of the receptacle 12 to allow visual observation of the defaced portion of the visual pattern.

In a further alternative embodiment, the upper lenticular sheet 20 would be separate from indicator subassembly 16 and housed in a viewing apparatus such as the general type disclosed in the previous identified copending patent application rather than being mounted within cap 14. The visual pattern and any defacement thereof would be visible with the aid of a viewer providing the upper lenticular sheet. In order to determine whether cap 14 has been moved, the container assembly would be inserted into the viewer and supported to maintain the lower lenticular sheet 22 to a predetermined position relative to upper lenticular sheet 20 mounted within the viewer. The predetermined visual pattern would then be visible through the viewer. The presence of a defaced portion of the visual pattern would indicate the cap had been moved.

This embodiment provides a more sophisticated indicator assembly since the characteristics of the upper lenticular sheet and the expected predetermined visual pattern therefrom could not be determined from any type of analysis of the cap alone. Thus, a highly secure identification and tamper-indication system is provided.

Figure 3:
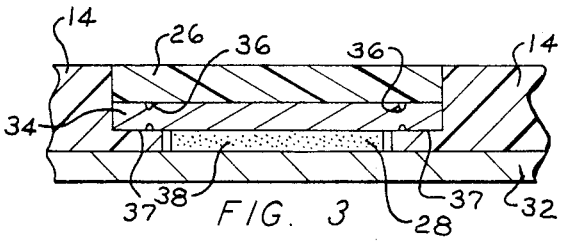
FIG. 3 is an enlarged sectional view similar to FIG. 2 of an alternate embodiment.

Referring to FIG. 3, a further alternate embodiment is shown wherein indicator subassembly 16 comprises a printed surface or sheet element 34 having a plurality of perforations 36 therein mounted within the bore 18 of cap 14. Sheet element 34 is seated on annular shoulder 37 and overlaid with a transparent layer or window 26. The printed surface and/or perforations present a distinctive visual pattern through the window 26 which is readily observable from the top of the container assembly 10.

Adhesive material 28 binds a portion of the lower surface 38 of sheet element 34 to the manufacturer's seal 32. Adhesive material 28 is of sufficient bonding strength that movement of cap 14 relative to receptacle 12 causes the adhesive material 28 to rip away a portion of sheet element 34 to thereby markedly deface the visual pattern presented through window 26. The printed surface together with the presence of the perforations 36 is of sufficient intricacy to prevent duplication. The perforations 36 also facilitate the easy tearing away of a portion of the sheet element 34. Alternately, adhesive material 28 can bind the printed surface of sheet element 34 directly to the rim of the receptacle 12 rather than to the seal 32.

Figure 4:
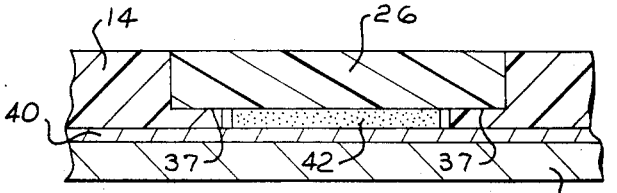
FIG. 4 is an enlarged sectional view similar to FIG. 2 of another alternate embodiment.

A still further embodiment is shown in FIG. 4 wherein a sheet element 40 having a printed surface thereon forming a visual pattern is affixed to the manufacturer's seal 32. The transparent window 26 is mounted within bore 18 of cap 14 and seated upon shoulder 37. A transparent adhesive material 42 binds the sheet element 40 to the transparent layer or window 26. Thus, the visual pattern presented by sheet element 40 is readily visible through transparent window 26 and the transparent adhesive material 42. Upon movement of cap 14 relative to receptacle 12, the adhesive material will cause sheet element 40, or sheet element 40 and seal 32, to rip or tear, thereby defacing the visual pattern to indicate the cap has been moved. Again, the intricacy of the visual pattern prevents replacement or repair of the sheet element 40.

Figure 5:
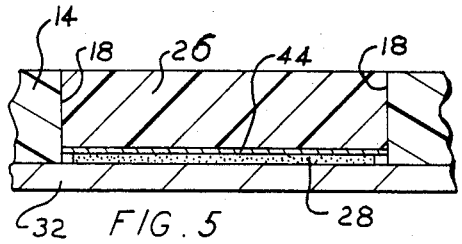
FIG. 5 is an enlarged sectional view similar to FIG. 2 of still another alternate embodiment.

Referring to FIG. 5, a still further alternate embodiment is shown having a printed surface or layer 44 on the lower face of a transparent window 26 to form a visual pattern. Transparent window 26 is mounted within the bore 18 of cap 14 so that the visual pattern is visible through the window 26 from the top of cap 14. The printed surface or layer 44 is adhered to the manufacturer's seal 32 by adhesive material 28 so that movement of cap 14 relative to receptacle 12 will cause adhesive material 28 to tear away and thereby markedly deface the visual pattern presented by the printed surface. In addition, the seal 32 could be printed for example with the term "Void" to show through the window 26 when the printed layer 44 is torn away.

In the illustrated embodiments, the indicator subassembly 16 presents a predetermined defaceable visual pattern that can be readily observed from above the cap 14. An adhesive material interconnects the defaceable visual pattern with the cap 14 and receptacle 12 so that movement of the cap relative to the receptacle causes the adhesive material to deface the visual pattern so as to be substantially irreparable. Also, the cap 14 can be readily removed and reinstalled for use of the container in a normal manner. While an adhesive material is shown, other acceptable mechanical means may be utilized for operatively connecting the visual pattern to the receptacle so that relative movement of the cap causes defacement of the visual pattern.

The defaced pattern provides an immediate and positive visual indication of tampering that the public can be quickly educated to recognize as such. Because of the nature of the visual patterns, and particularly the patterns formed by the lenticular sheet assembly, the patterns cannot be repaired or duplicated to allow repackaging of the container after adulteration of the contents. Also, the visual indicator can be readily coded for each application and in accordance with the origin or manner of distribution of the product for tracing a tampered product. Furthermore, the tamper-indicating container assembly is easily compatible with present packaging machines and adaptable to a wide variety of conventional packaging forms.

While a conventional bottle-type receptacle is illustrated, it is apparent to one of ordinary skill in the art that the described tamper-indicating container assembly can be utilized with all types of containers and packaging wherein deleterious tampering may occur. Also, it is apparent that various modifications, adaptations and variations of the foregoing specific disclosure can be made without departing from the scope of the invention.

What is claimed is:

1. A tamper-indicating container assembly comprising:

a receptacle portion for holding material to be dispensed, said receptacle portion having an opening for removal of the material held therein, a removable cap means for closing off said receptacle opening to maintain the material therein, said cap means having a transparent window, an indicator assembly forming a defaceable visual pattern and being connected to said cap means so that said visual pattern is viewable through said window when said cap means is mounted on said receptacle portion, and means for binding said visual pattern to said receptacle so that movement of said cap means relative to said receptacle defaces said visual pattern so as to be substantially irreparable with said defaced visual pattern being viewable through said window.

2. The asembly of claim 1 wherein said indicator means is a lenticular assembly comprising upper and lower lenticular sheets mounted to produce a visual pattern facing outwardly from said cap means, said lower sheet having a defaceable reflective coating thereon, and said binding means comprises a means for operatively adhering a portion of said reflective coating to said receptacle so that upon the movement of said cap means said portion of said reflective coating from said lower sheet is separated from said lower sheet to deface the visual pattern of said lenticular assembly to visually indicate the cap means had been moved.

3. The assembly of claim 2 wherein said adhering means comprises an adhesive material binding said portion of said reflective coating directly to said receptacle so that said portion adheres to said receptacle subsequent to the initial movement of said cap means to deface said visual pattern.

4. The assembly of claim 2 wherein said receptacle has a removable seal disposed over said opening, and said adhering means comprises an adhesive material binding said portion of said reflective coating to said seal so that said portion adheres to said seal subsequent to the movement of said cap means to deface said visual pattern.

5. The assembly of claim 4 wherein said seal is composed of puncture-resistant material.

6. The assembly of claim 2 wherein a layer of transparent material overlays said lenticular assembly.

7. The assembly of claim 18 wherein said cap means has a transparent portion therethrough, and said indicator means is a defaceable printed surface forming a visual pattern, said printed surface being disposed adjacent said transparent portion so as to to be visible through said cap means.

8. The assembly of claim 7 wherein said printed surface is affixed to said cap means and said connecting means comprises an adhesive material binding a portion of said printed surface directly to said receptacle so that said portion adheres to said receptacle subsequent to the movement of said cap means to deface said visual pattern of said printed surface to visually indicate the cap means had been moved.

9. The assembly of claim 7 wherein said receptacle has a removable seal disposed over said opening, said printed surface is affixed to said seal, and said connecting means comprises a transparent adhesive material binding a portion of said printed surface to said transparent portion of said cap means so that said portion of said printed surface adheres to said cap means subsequent to the movement of said cap means to deface said visual pattern to indicate the cap means had been moved.

10. The assembly of claim 9 wherein the adhesive strength of said transparent adhesive material is sufficient relative to the cohesive strength of said seal to cause said seal to separate upon the movement of said cap means.

11. The assembly of claim 7 wherein said receptacle has a removable seal disposed over said opening, said printed surface is affixed to said cap means, and said connecting means comprises an adhesive material binding a portion of said printed surface to said seal so that said portion adheres to said seal subsequent to the movement of said cap means to deface said visual pattern to indicate the cap means had been moved.

12. The assembly of claim 18 wherein said cap means has a transparent portion therethrough, and said indicator means is a defaceable perforated sheet having a visual pattern, said perforated sheet being disposed adjacent said transparent portion of said cap means so as to be visible through said cap means.

13. The assembly of claim 12 wherein said perforated sheet is affixed to said cap means and said connecting means comprises an adhesive material binding a portion of said perforated sheet directly to said receptacle so that said portion adheres to said receptacle subsequent to the movement of said cap means to deface said visual pattern of said perforated sheet to visually indicate the cap means had been moved.

14. The assembly of claim 12 wherein said receptacle has a removable seal disposed over said opening, said perforated sheet is affixed to said seal, and said connecting means comprises a transparent adhesive material binding a portion of said perforated sheet to said transparent portion of said cap means so that said portion of perforated sheet adheres to said cap means subsequent to the movement of said cap means to deface said visual pattern to indicate the cap means had been moved.

15. The assembly of claim 12 wherein said receptacle has a removable seal disposed over said opening, said perforated sheet is affixed to said cap means, and said connecting means comprises an adhesive material binding a portion of said perforated sheet to said seal so that said portion of said sheet adheres to said seal subsequent to the movement of said cap means to deface said visual pattern to indicate the cap means had been moved.

16. The assembly of claim 1 wherein said receptacle has a removable seal of puncture-resistant material disposed over said opening.

17. The assembly of claim 1 wherein said receptacle is composed of puncture-resistant material.

* * * * *

UNITED STATES PATENT AND TRADEMARK OFFICE

CERTIFICATE OF CORRECTION

PATENT NO. : 4,475,661

DATED : October 9, 1984

INVENTOR(S) : Robert B. Griffin

It is certified that error appears in the above-identified patent and that said Letters Patent are hereby corrected as shown below:

Column 6, line 34, change "claim 18" to read --claim 1--.

Column 7, line 8, change "claim 18" to read --claim 1--.

Signed and Sealed this

*Fourth* Day of *June 1985*

[SEAL]

*Attest:*

DONALD J. QUIGG

*Attesting Officer* *Acting Commissioner of Patents and Trademarks*